US005206656A

United States Patent [19]

Hannan

[11] Patent Number: 5,206,656

[45] Date of Patent: Apr. 27, 1993

[54] ARRAY ANTENNA WITH FORCED EXCITATION

[76] Inventor: Peter W. Hannan, 22 Ursular Ct., Smithtown, N.Y. 11787

[21] Appl. No.: 458,220

[22] Filed: Dec. 28, 1989

[51] Int. Cl.[5] ..... H01Q 1/28

[52] U.S. Cl. ..... 343/705

[58] Field of Search ..... 343/705, 770, 700 MS, 343/749, 751, 844, 845, 853, 893, 905, 872, 864, 862

[56] References Cited

U.S. PATENT DOCUMENTS

| | | | |
|---|---|---|---|
| 2,241,582 | 5/1941 | Buschbeck et al. | 343/862 |
| 2,607,008 | 8/1952 | Guarino et al. | 343/864 |
| 3,508,269 | 4/1970 | Snyder | 343/864 |
| 3,725,938 | 4/1973 | Black et al. | 343/705 |
| 3,731,313 | 5/1973 | Nagai | 343/893 |
| 4,110,751 | 8/1978 | Reggia et al. | 343/705 |
| 4,336,543 | 6/1982 | Ganz et al. | 343/705 |
| 4,392,139 | 7/1983 | Aoyama et al. | 343/705 |
| 4,451,829 | 5/1984 | Stuckey, Jr. et al. | 343/705 |
| 4,514,734 | 4/1985 | Cermignani et al. | 343/708 |
| 4,749,997 | 6/1988 | Canonico | 343/705 |

FOREIGN PATENT DOCUMENTS

| | | |
|---|---|---|
| 0074762 | 3/1983 | European Pat. Off. . |
| 3315685 | 10/1984 | Fed. Rep. of Germany . |
| 3315686 | 10/1984 | Fed. Rep. of Germany . |

*Primary Examiner*—Rolf Hille
*Assistant Examiner*—Hoanganh Le

[57] ABSTRACT

Low profile array antennas for aircraft achieve improved performance with excitation circuits providing forced excitation of radiating elements to generate signals of desired relative phase and amplitude at the elements. Excitation circuits are structured for use of reactive turning for wideband operation. Monopole or slot array antennas, each including three or more radiating elements, can be grouped as antenna systems.

39 Claims, 8 Drawing Sheets

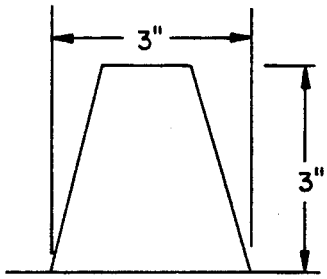
FIG. 1a-i
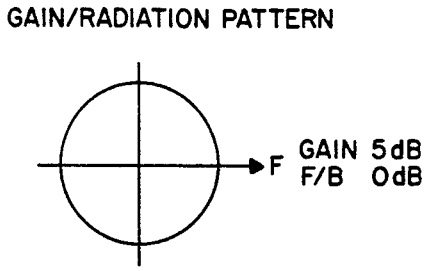
FIG. 1a-ii
PRIOR ART
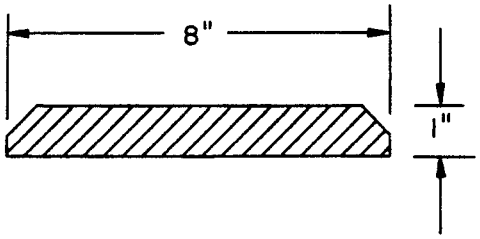
FIG. 1b-i
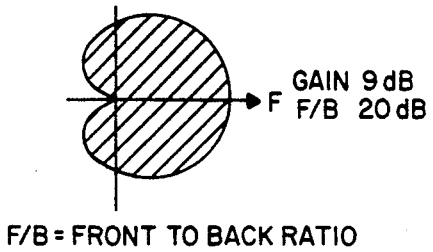
FIG. 1b-ii
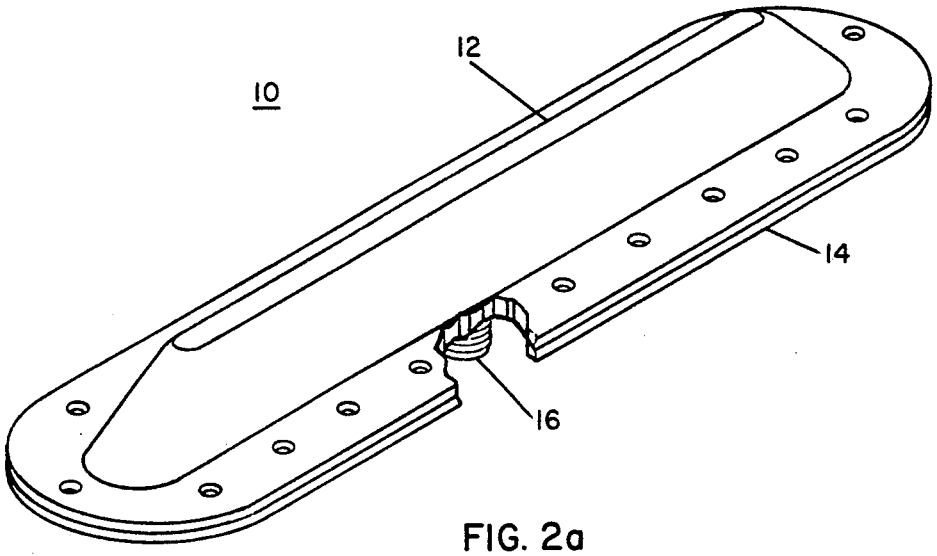
FIG. 2a 12
18
20
22
24
28
26
14
16
12
18
26
16
14

ARRAY ANTENNA WITH FORCED EXCITATION

BACKGROUND OF THE INVENTION

The present invention relates to antennas for radiating and receiving electromagnetic signals and, in particular, to array antennas adapted for use on aircraft.

DESCRIPTION OF RELATED ART

Identification Friend or Foe ("IFF") systems operating with signals of wavelength in the range of one foot, for example, are widely used to permit aircraft to transmit and receive IFF signals for aircraft identification. Antennas used to radiate and receive IFF signals are commonly mounted on the outer surface of fighter and other aircraft, typically, requiring antennas with a height (dimension out from the surface) of approximately three inches, or about a quarter wavelength. FIG. 1*a* shows a side view of a prior-art antenna, called a "blade" in view of its narrow dimension perpendicular to the page, which is typically a quarter wave monopole with an associated protective cover. One or more antennas protruding three inches from fuselage surfaces of high speed aircraft have obvious undesirable attributes, including creation of drag, limitation of pilot's visibility, exposure to fracture during airborne refueling etc. In addition, prior antennas have typically been nearly omnidirectional, providing little antenna directional discrimination, Monopole, dipole and slot antennas may be used for these purposes and while there is an extensive body of prior art relating to such antennas, the undesirable features such as antenna height and limited directivity ave persisted. Use of monopoles substantially shorter than a quarter wavelength would alleviate physical disadvantages, but shortening a monopole tends to undesirably affect its electrical characteristics. The prior art encompasses the use of quarter wave sections, also called quarter wave transformers, in antenna applications and the use of tuning circuits to change or broaden the useable bandwidth. Nevertheless, the continuing use of aircraft antennas of height approximately a quarter wavelength, with omnidirectional or low antenna gain pattern characteristics, testifies to the absence in the prior art of a satisfactory solution of the problem of providing low drag, low visibility, impact resistant antennas suitable for applications like IFF systems and having improved antenna gain and directional characteristics.

The present inventor has developed antennas with excitation arrangements enabling significant reductions in antenna height and improved antenna patterns. For purposes of comparison with prior antennas, FIG. 1*b* shows the approximate profile and dimensions of an antenna which will be described in accordance with the present invention. Comparative antenna radiation patterns are shown to the right in FIG. 1 and the significantly improved directional pattern shown in FIG. 1*b* for the present invention will be described further.

It is an object of the invention to provide array antennas of reduced height and with improved gain and pattern characteristics, which are particularly suited to aircraft applications.

SUMMARY OF THE INVENTION

In accordance with the present invention, an array antenna includes terminal means for coupling signals and a plurality of antenna elements comprising at least first, second and third antenna elements for coupling radiated signals. First excitation means, coupled between the terminal means and the first and third elements, comprises signal transmission means for coupling signal components of predetermined relative phase and amplitude to the elements by way of a point of common voltage. Second excitation means, coupled between the terminal means and the second element, comprises means for coupling to the second element a signal component of predetermined phase and amplitude relative to the signal components coupled to the first and third elements; and the antenna further has tuning means coupled to the common voltage point for providing impedance matching. In operation, signal components in the antenna elements are caused to have a predetermined relationship of phase and amplitude, substantially independently of intercoupling affecting antenna elements of the array.

A low-profile array antenna suitable for aircraft installation in accordance with the invention includes a connector for coupling signals and a first planar conductor pattern providing first, second and third monopole antenna elements each less than one-eight wavelength in height. A second planar conductor pattern includes first excitation means for coupling the connector to the first and third elements by way of quarter wavelength transformers, second excitation means for coupling the connector to the second element, and tuning means for providing double tuning in a desired frequency range. The antenna also includes a protective cover of radiation transmissive material and a base member, having a reflective surface, which enclose and support the other antennas elements. The entire antenna can be about a tenth of a wavelength high and less than one wavelength long, exclusive of the connector protruding downward from the base, so that it is suited for aircraft installation with reduced visual and air flow interference.

For a better understanding of the present invention, together with other and further objects, reference is made to the following description, taken in conjunction with the accompanying drawings, and its scope will be pointed out in the appended claims.

BRIEF DESCRIPTION OF THE DRAWINGS

FIG. 1 compares a prior art antenna size and pattern with those of an antenna in accordance with the invention.

DETAILED DESCRIPTION OF THE INVENTION

Referring now to FIG. 2, there is shown the physical configuration of an array antenna 10 in accordance with the invention. FIG. 2*a* is an orthogonal view of the complete antenna including protective cover 12, of a radiation transmissive material such as fiberglass or a suitable plastic, base member 14, of metal or suitable conductive material to serve as a mounting flange and ground plane connection, and terminal means 16, shown as a coaxial connector suitable for coupling RF signals.

Figures 2B, 2C:
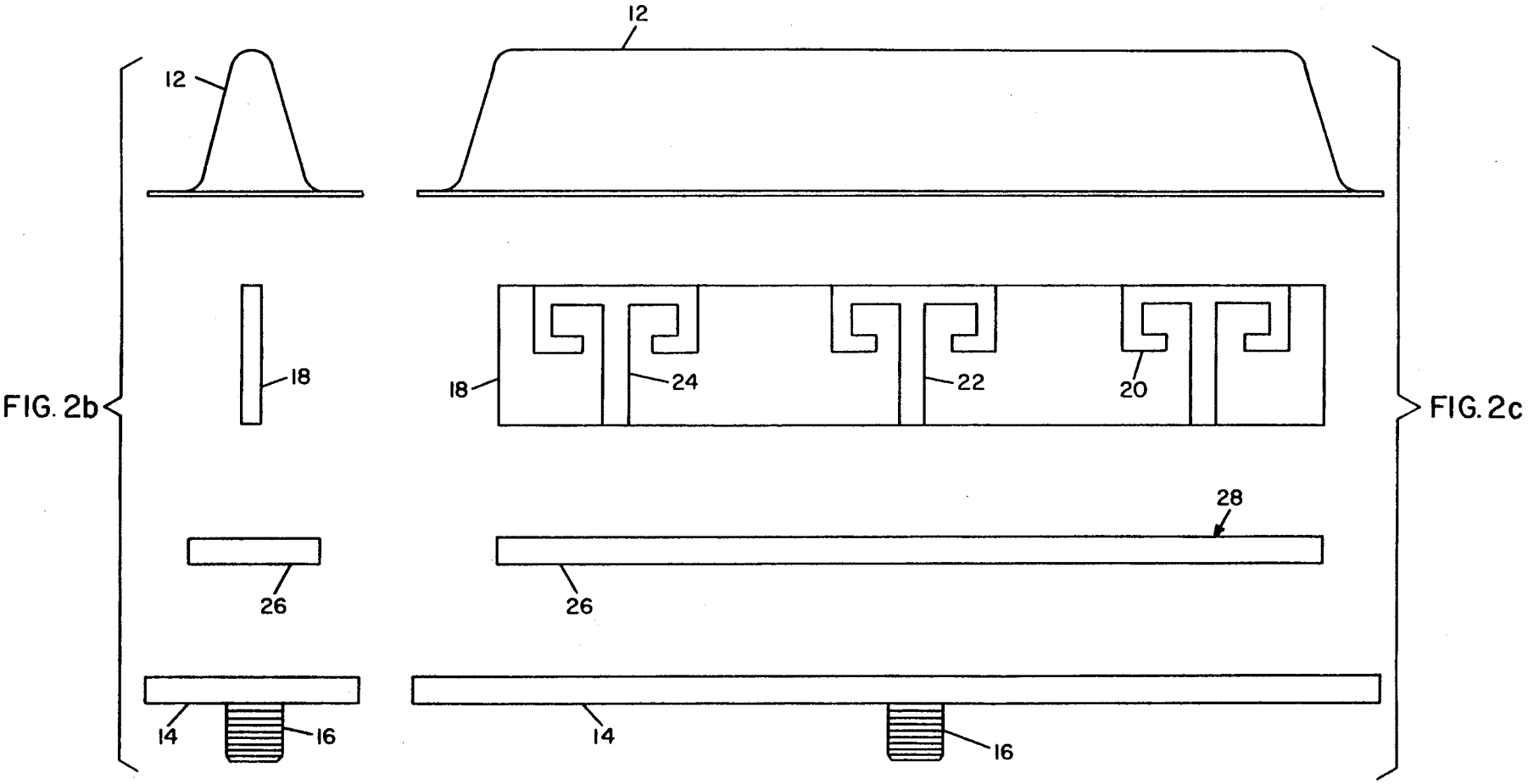
FIG. 2 shows orthogonal and simplified exploded views of an array antenna in accordance with the invention.

FIG. 2*b* and *c* are exploded end and side views, respectively, of the array antenna 10, showing cover 12 and base member 14 with connector 16 attached. Also shown are a first printed circuit card 18 bearing a first planar conductor pattern of forward, middle and rear monopole antenna elements 20, 22 and 24, respectively, and a second printed circuit card 26 bearing a second planar conductor pattern on surface 28. The conductor pattern on surface 28, which is not visible in these views, will be described below.

In a specific embodiment of the antenna 10, the assembled combination of the cover 12 and base 14 had a height of approximately one-tenth wavelength and length of about three-quarter wavelength. References to dimensions measured in wavelength refer to approximately the average design frequency, so that for a design frequency range or bandwidth of 1,020 to 1,100 MHz, for example, for average design frequency would be 1,060 MHz, corresponding to a wavelength of about 11.1 inches. Dimensions are stated in order to characterize the invention and differentiate over prior art antennas, and are not intended to suggest that the invention is limited to precise dimensions or exclude antennas representing appropriate applications of the invention. As shown in FIG. 2, the lower surface of base member 14 is flat, but in other embodiments it may be a curved surface corresponding to the curved surface of an aircraft to which it is to be mounted. For mounting, screws are typically fastened through the mounting holes shown in FIG. 2*a* and a clearance hole through the outer surface of the aircraft is provided for the connector 16, so that it can be joined to a mating connector for coupling signals to cabling and signal processing equipment carried within the aircraft.

Figure 3:
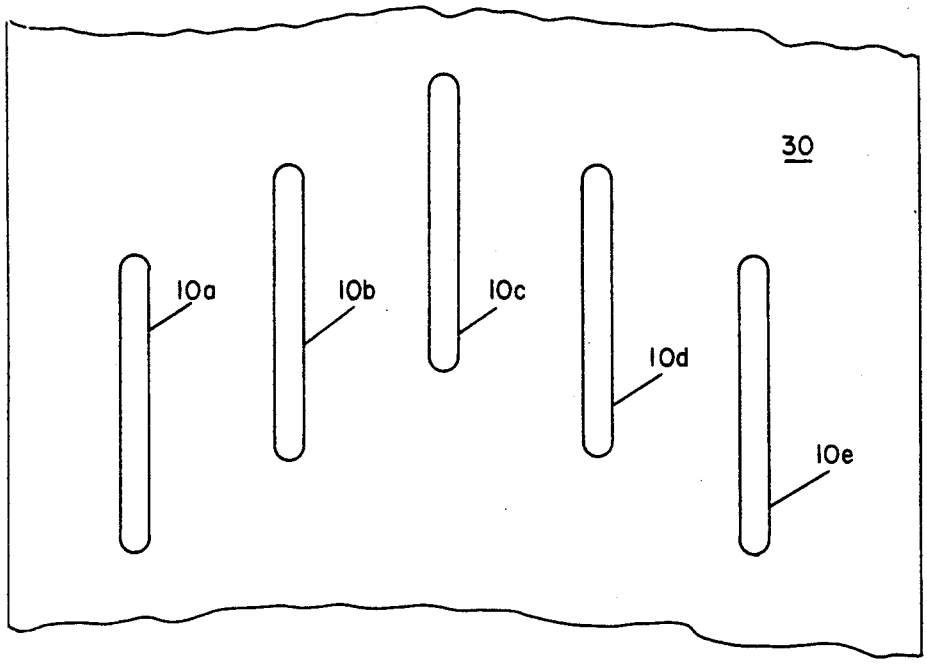
FIG. 3 is a plan view showing an arrangement of five FIG. 2 array antennas.

FIG. 3 shows a typical antenna system including five array antennas 10*a, b, c, d,* and *e* supported in a laterally spaced configuration on a curved metal surface 30 such as the fuselage of an aircraft, forward of the pilots' windshield. It will be apparent that in such an installation, use of array antennas one inch in height provides a dramatic improvement in the pilot's visibility, as compared to use of prior art antennas three inches in height. In an installation of this type, the individual array antennas can be excited in groupings selected to provide desired antenna beam characteristics, in accordance with known principles of array antenna excitation. An antenna system as shown in FIG. 3, when installed on the upper forward surface of an aircraft, can provide broad horizontal coverage forward of the aircraft and good vertical coverage, except below the aircraft. A similar antenna system installed on the lower forward surface of the aircraft would permit full vertical and horizontal coverage forward of the aircraft. Alternatively, antenna systems mounted near the leading edge of the wing could provide complete vertical coverage, but would probably require similar systems on the other wing in order to provide complete horizontal coverage free of blockage by the nose of the aircraft.

Figure 4:
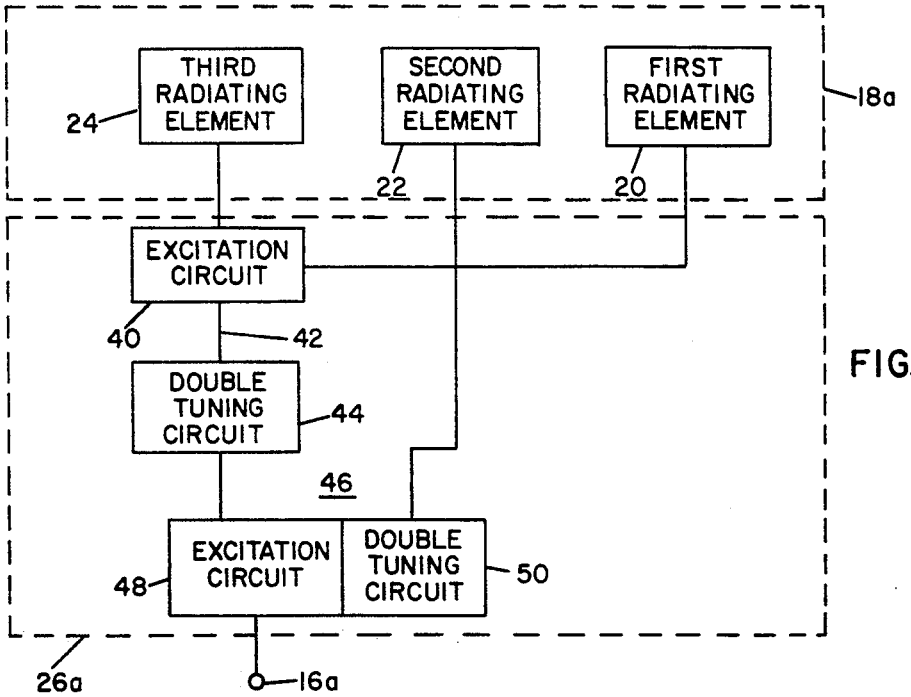
FIG. 4 is a block diagram of an array antenna in accordance with the invention.

FIG. 4 is a simplified block diagram of an array antenna in accordance with the invention, shown in two sections 18*a* and 26*a* corresponding basically to the printed circuit cards 18 and 26 in FIG. 2. The antenna is used to alternatively radiate and receive signals, in the range of 1,020 MHz to 1,100 MHz, which are coupled to and from the antenna by way of the terminal means 16*a* corresponding to connector 16 in FIG. 2. The cover and base components, 12 and 14, are not represented in FIG. 4. As noted, the antenna is used both to radiate and receive signals, and description of how signals are processed by various portions of the antenna when radiating, for example, will be understood to be equally relevant in a reverse relationship during reception.

The FIG. 4 antenna includes first, second and third antenna elements 20, 22 and 24, which in accordance with the invention may be monopoles of the order of one-tenth wavelength in height arranged in a spaced linear array. While the desirability of using antenna elements one-tenth wavelength high as compared to prior art elements one-quarter wavelength high may be readily apparent, the severe operational bandwidth degradation normally associated with short antenna elements such as monopoles has been a limiting factor contributing to the continuing reliance on quarter wave elements in the prior art. In addition, attempts to use elements shorter than a quarter wavelength in an array configuration with prior art excitation arrangements have been subject to severe effects of intercoupling between adjacent and other combinations of the antenna elements and nearby surfaces, as a result of effects of unequal and complex mutual impedances between individual antenna elements in an array. These effects, which do not readily yield to design compensation, largely determine the actual currents in the antenna elements and the resulting antenna pattern. It will be appreciated that if the currents in the various elements cannot be accurately determined and proportioned, neither can a desired antenna pattern be provided. While the basic description of the invention will be in the context of arrays of three elements, denoted as "first, second and third" elements, additional elements may be included as will be described. However, regardless of the total number of antenna elements, each antenna will include three elements meeting the description and function of the first, second and third elements as set out and claimed.

Section 26*a* of the FIG. 4 antenna as shown comprises excitation and tuning means which are effective to cause signal currents in the antenna elements 20, 22 and 24 to have a predetermined relationship of phase and amplitude substantially independent of impedance interaction, and are able to accomplish this over a significant band or range of operating frequencies. As shown, antenna portion 26*a* includes first excitation means shown as excitation circuit 40, coupled between terminal 16*a* and the first and third elements 20 and 24, comprising signal transmission means (as will be discussed in more detail with reference to FIG. 6) for coupling signal components to elements 20 and 24 by way of a point of common voltage, shown as point 42 on the connection between excitation means 40 and tuning means shown as double tuning circuit 44. Tuning circuit 44, provides double tuning of the impedance characteristics of the antenna circuits to optimize for operation in a desired frequency range. While circuit 44 is shown as being connected in series between terminal 16*a* and point 42, its function is to provide wideband impedance matching and it may comprise discrete or distributed reactances coupled to point 42 in series as shown, or in parallel to ground, or may utilize appropriate lengths of transmission line, as will be apparent to those skilled in the art. Section 26*a* also includes means 46 shown as including second excitation circuit 48, coupled between terminal 16*a* and second element 22, comprising means for coupling a signal component to the element 22 which has a predetermined phase and amplitude relative to the components coupled to elements 20 and 24 via first excitation means 40. As shown in FIG. 4, excitation circuit 48 functions as a power divider coupling a portion of the input signal from terminal 16*a* to element 22, while the remaining portion of the input signal flows from the terminal 16*a* to the other elements. This power divider function of circuit 48 may be provided by a directional coupler (as will be discussed with reference to FIG. 6) or other means. In FIG. 4, means 46 also includes double tuning circuit 50 for providing double tuning of the impedance characteristics of the middle element 22 for operation in a desired frequency band or range. Where distributed reactances or transmission lines in excitation means 48 are used to provide the double tuning function, means 50 may not appear as a discrete element.

Figure 5:
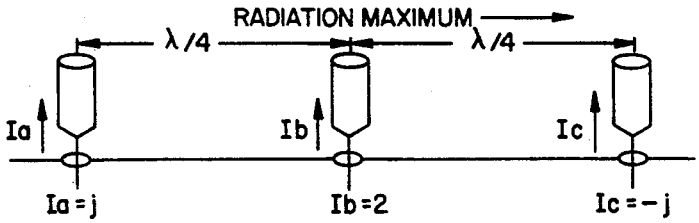
FIG. 5 shows desirable current relationships for an end-fire array.
Figure 6:
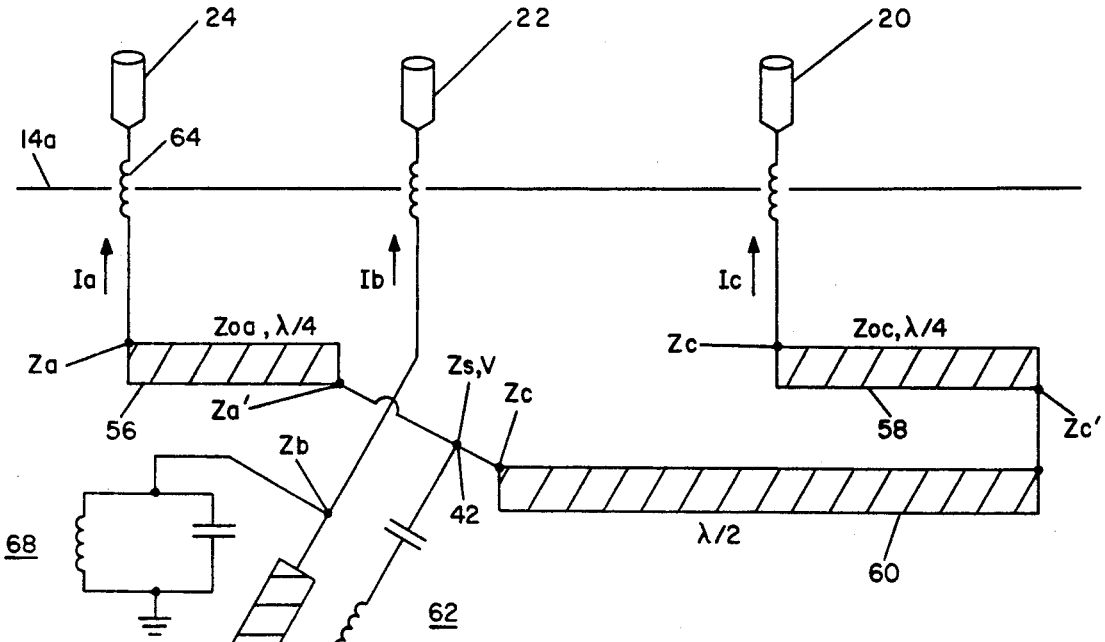
FIG. 6 is a circuit diagram of a three monopole array antenna in accordance with the invention.

FIG. 5 shows a three monopole array arranged to provide an end-fire pattern and FIG. 6 shows such an array antenna with an excitation system in accordance with the invention. A good end-fire pattern is obtainable from the FIG. 5 array if the elements have the spacings and the phase and amplitude of currents shown. FIG. 6 shows an antenna with an excitation system effective to provide "forced excitation" to cause signal component currents in the antenna elements to have such a predetermined relationship of phase and amplitude, substantially independently of intercoupling affecting the antenna elements, with double tuning to provide for operation over a significant range of frequencies. "Forced excitation" is defined as an excitation arrangement which forces or predetermines the currents in the elements of an array antenna so as to result in currents of desired relative magnitude and phase, substantially independently of mutual and other coupling and impedance effects.

In FIG. 6 there are included first, second and third antenna elements, shown as short monopoles 20, 22 and 24 mounted through and above a conductive ground plane 14*a*. The FIG. 6 array antenna includes first excitation means comprising quarter wave transformer 56 coupled to third monopole 24, and quarter wave transformer 58 and half wave transmission line 60 coupled to first monopole 20. Transformer 56 and line 60 are also shown coupled to common voltage point 42, as is tuning means 62 which is also coupled to signal input and output terminal 16*a*. Tuning means 62 is a series resonant LC circuit arranged for double tuning the impedance of rear and forward monopoles 24 and 20. Each of the monopoles is shown as having a series inductance at its base, such as inductor 64 at element 24, for tuning out the capacitive impedances of the short monopole element at one frequency near midband. This narrow band tuning is augmented by the double tuning means 62 to provide substantially increased bandwidth. The FIG. 6 antenna also includes second excitation means comprising a directional coupler 66, for coupling signals of predetermined relative amplitude to the second monopole 22, and second tuning means 68. As shown, coupler 66 is coupled to terminal 16*a* and is effective to transfer a portion of a signal input to the antenna to monopole 22 by way of transmission line section 70. Second tuning means 68 is a parallel resonant LC circuit arranged for double tuning the impedance of second monopole 22, and the length of line 70 is chosen so that signals reaching monopole 22 have the desired relative phase as compared to signals at monopoles 20 and 24.

In operation of the FIG. 6 array antenna, the two quarter wave transformers 56 and 58 force the currents Ia and Ic in the third and first monopoles 24 and 20 to be dependent substantially wholly on the voltage at the common voltage point 42. Thus, Ia and Ic are forced to be in the ratio Ic/Ic=Zoc/Zoa, where the latter are the respective transmission line impedances of the transformers 58 and 56. The half wave line 60 introduces a reversal in the polarity of Ic at element 20, relative to Ia at element 24. The ratio of Ib to the Ia and Ic currents is not forced and cannot be forced because of the 90° phase difference needed to obtain the desired signal component relationship of Ia=j, Ib=2 and I=−j, as shown in FIG. 5. However, if Ia=−Ic then the second monopole 22 will effectively be at a null point midway between the equal and opposite signals at elements 20 and 24 and no net signal from those monopoles will be coupled to element 22. In this case there is no need for Ib to element 22 to be forced.

As a specific example, computations of impedance were made using a commercial computer program for three monopoles arranged as in FIG. 5 with currents as in FIG. 5. The computations were made at 1,030 MHz, 1,060 MHz, and 1,090 MHz for an array of three identical monopoles one inch high, 1.6 inches wide at the top and with center-to-center spacing of 2.78 inches. Computed results were as follows:

| | 1030 | 1060 | 1090 |
|---|---|---|---|
| Za | −0.89–j61.8 | −0.6–J57.0 | −0.31–J52.7 |
| Zb | 6.0 –J57.4 | 6.4–J52.6 | 6.8–j48.1 |
| Zc | 14.7 –J47.5 | 15.7–j42.4 | 16.7–J37.8 |
| Za + Zc | 13.8 –j109.3 | 15.1–j99.4 | 16.4–j90.5 |

With reference to FIG. 6:

$$Ys = Ya' + Yc'$$

For quarter wave transformers:

$$Ya' = Za/Zoa^2 \quad Yc' = Zc/Zoc^2$$

Let Zoa=kZoc $$\begin{aligned} Zs &= Zoa^2/(Za + k^2Zc) \\ &= Zo^2/(Za + Zc), \text{ if } k = 1 \\ \text{where } Zoa &= Zoc = Zo \end{aligned}$$

From the table above, with the reactance tuned out at midband by the series inductances such as 64, Za+Zc is approximately equal to 15 ohms.

From the last equation, and assuming we want Zs to be 50 ohms:

$$Zo^2 = Zs\,(Za + Zc)$$
$$= 50\,(15)$$
$$Zo = 27.4 \text{ ohms}$$

Note that in FIG. 6, the quarterwave transformers and transmission line sections are shown as being sections of microstrip transmission line that is dimensioned to provide the desired characteristic impedances. Thus, lines 60 and 70 in this example would be 50 ohm line sections and transformers 56 and 58 would be 27.4 ohm sections one quarter wavelength long at a frequency of 1,060 MHz. Reactive tuning circuits 62 and 68 are used to optimize antenna performance at 1,030 MHz and 1,090 MHz, i.e.—are adjusted to double tune the respective antenna elements at those frequencies. Note also that, because of mutual coupling, Za has negative resistance, making it very difficult to precisely and efficiently provide the desired Ia over a frequency band, in the absence of the invention. However, (Za+Zc) has a substantial positive resistance which can be efficiently double tuned while providing the desired Ia and Ic values, in accordance with the invention. Achievement of an array antenna pattern with a high front-to-back ratio and strong radiation over a wide angle in the front sector requires precise control of the relative currents in the array elements, as made possible by the present invention.

Figure 7:
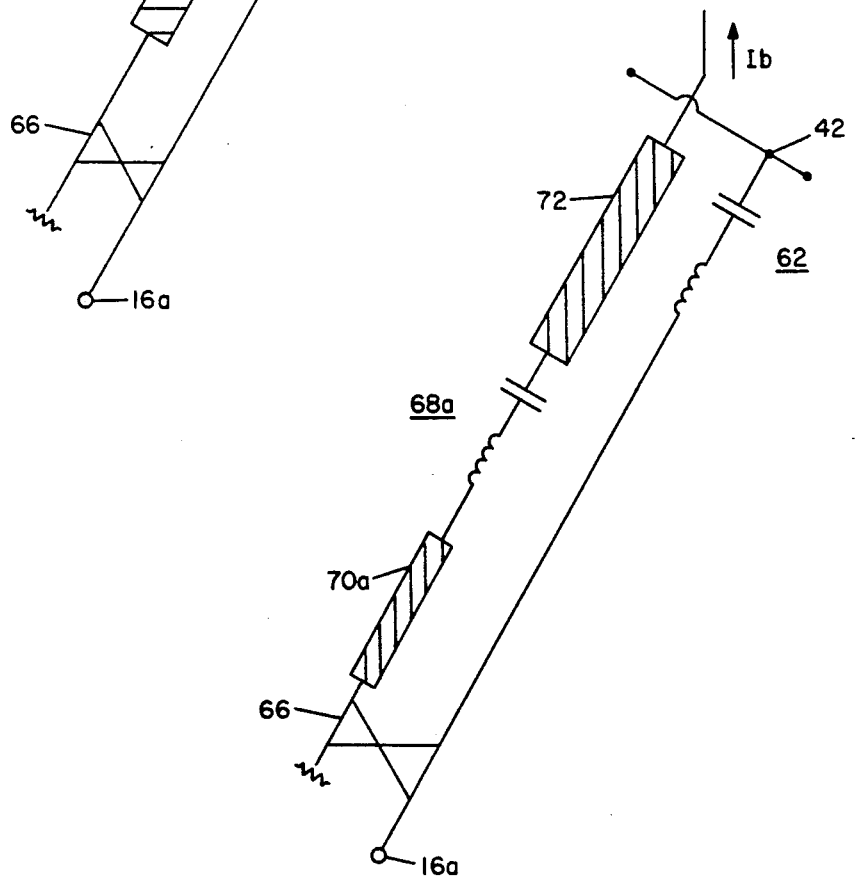
FIG. 7 and 8 are circuit diagrams of alternative forms of the FIG. 6 antenna.
Figure 8:
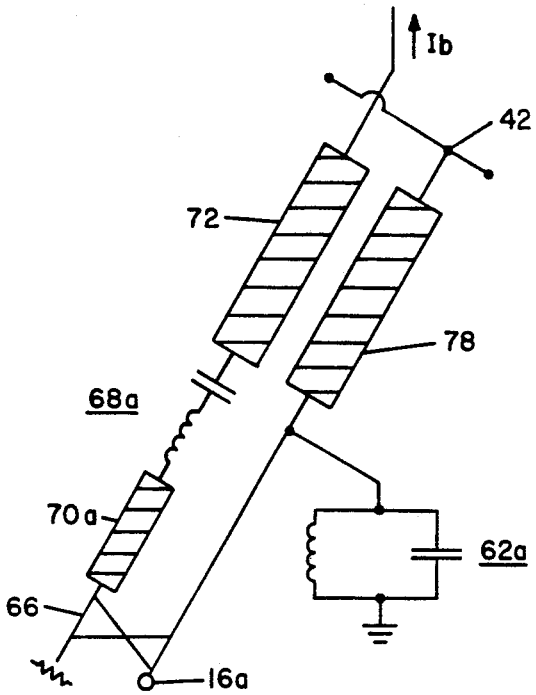

Referring now to FIGS. 7 and 8, there are shown alternative excitation circuits for array antennas similar to the FIG. 6 antenna. For the FIGS. 7 and 8 antennas the monopoles and the excitation means between point 42 and the monopoles 20 and 24 are the same as shown in FIG. 6. In FIG. 7 the excitation means for the second element includes a quarter wave transformer 72 similar to transformers 56 and 58 in FIG. 6. Zo of 72 should be different than Zo of 56 and 58. In the FIG. 7 antenna the tuning function can be provided by a series resonant LC circuit 68*a* and the length of line 70*a* can be reduced, otherwise operation corresponds to operation of the FIG. 6 antenna. In FIG. 8 the excitation means for the forward and rear elements includes a quarter wave transformer 78 similar to transformer 72 included in the second element excitation means in FIG. 7. In the FIG. 8 arrangement the parallel resonant LC circuit 62*a* provides the tuning function, and operation again corresponds to operation of the FIG. 6 antenna. The LC circuits, such as 68*a* and 62*a*, may use discrete reactance components or appropriate lengths of transmission line, as will be apparent to those skilled in the art.

Figure 9:
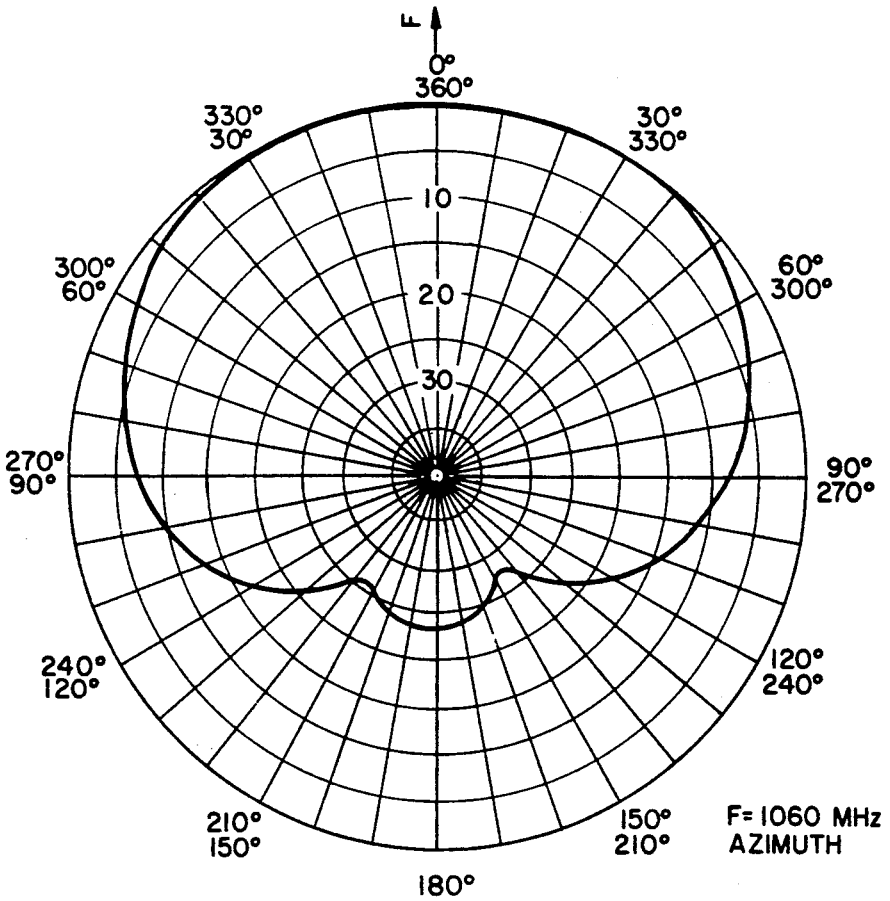
FIG. 9 is an antenna pattern for operation of an array antenna of the type shown in FIG. 6.

FIG. 9 is an actual measured azimuth antenna pattern at 1,060 MHz for an array antenna with three monopoles resembling those shown in FIG. 2*c*, with a monopole width of 2 inches, spacing of 2.78 inches and height of 0.91 inches, after adjustments for the excitation circuits intended to optimize the results achieved. Note that the front-to-back ratio is greater than 20 dB, and the pattern remains strong over a wide angle in the front sector. Similar results were obtained at 1030 and 1090 MHz. It is believed that the antenna performance reflected in this data is clearly beyond the performance of any known prior art monopole array antenna of comparable dimensions.

Figure 10:
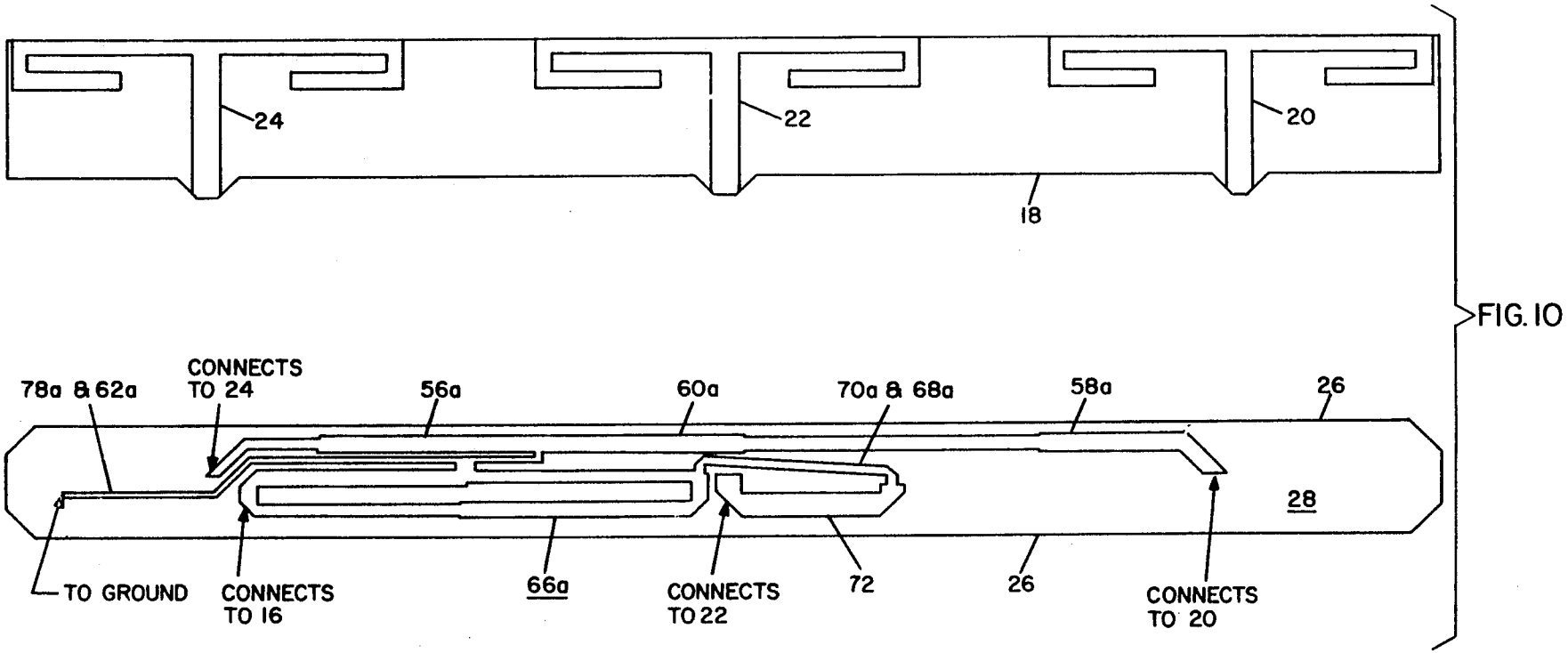
FIG. 10 illustrates component parts of an array antenna of the type shown in FIG. 6.

FIG. 10 shows printed circuit cards 18 and 26 designed for this antenna. On card 18, three monopoles 20, 22 and 24 as shown were formed by etching a copper layer on dielectric card 18 to leave conductive patterns in the form of the monopoles. Thus, with the dimensions noted above with reference to FIG. 9, this FIG. 10 antenna with operation in the 1,060 MHz range (corresponding to an average wavelength of about 11.1 inches as noted above) utilizes monopoles 20, 22 and 24 approximately one-tenth wavelength in height (actual height 0.91 inches) with each monopole having arms projecting forward and rearward approximately one-tenth wavelength (total width of 2 inches, noted above) as shown in FIG. 10. The pattern shown on surface 28 of the card 26 was similarly formed. The actual pattern shown on card 26 represents microstrip transmission line sections of various lengths and characteristic impedances, together with interconnecting points and sections, designed to implement the antenna in a physically simple form providing ease of production and assembly, consistent electrical characteristics, inherently high reliability and good durability under shock and vibration conditions common in high-performance aircraft applications. While reference numbers corresponding to the FIG. 6 antenna, with substitution of the alternative excitation circuit of FIG. 8, have been included in FIG. 10, it will be understood that reducing the antenna to a microstrip layout, and refining that configuration for maximum performance, results in a final physical embodiment of the invention in this example in which there is a degree of inherent masking of the indentification of discrete components. Thus, while portions of the conductive pattern on card 26 in FIG. 10 have been given identifying numerals, it may be difficult or not possible to specifically identify the metes and bounds of a particular component so as to separate it from the remainder of the circuit.

Figure 11:
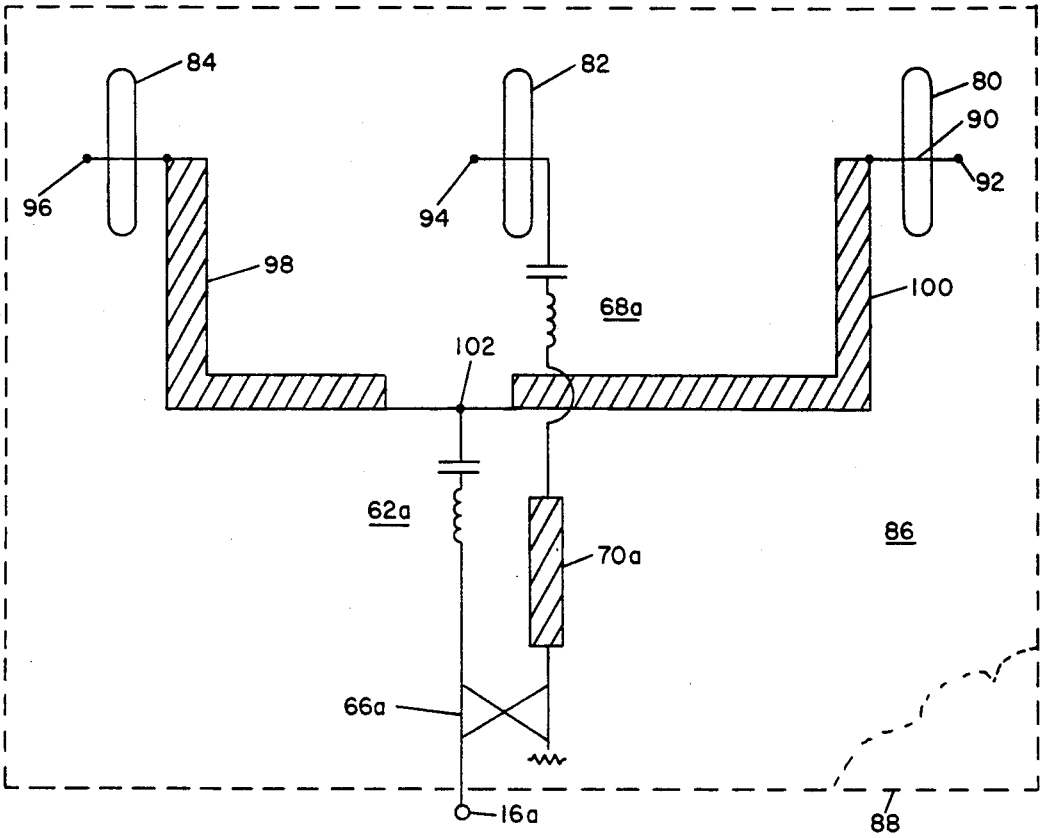
FIG. 11 is a circuit diagram of a three slot array antenna in accordance with the invention.

FIG. 11 shows an array antenna in accordance with the invention wherein the individual radiating elements are slots. A three element slot array, as shown, is subject to disruptive mutual coupling effects similar to those previously discussed with reference to monopoles. Slots 80, 82 and 84 in FIG. 11 may simply be openings in a conductive covering 86 on the forward side of a dielectric sheet 88. Conductive covering 86 and dielectric sheet 88 are both shown as being transparent for ease of illustration in order to make visible the other elements which may be disposed on the backside of the dielectric sheet, as shown.

Each of the slots or windows 80, 82 and 84 in the conductive member 86 may typically be a half wavelength long or, alternatively, may be shorter with shunt capacitances inserted across the center of the slot at one frequency near midbound. The slots in the array are spaced by a quarter wavelength, with a width equal to a fraction of the spacing. Dimensions can be selected for particular applications using known design techniques. As shown, each slot is excited by a conductor passing across the slot on the back of the dielectric sheet, as shown at 90, and passing forward or upward through the dielectric 88 to terminate at a point 92 in electrical contact with the conductive covering 86 at the side of slot 80. As shown, slot 80 has an excitation conductor termination point 92 at its right side and will be excited with a phase or a polarity of excitation opposite to that of slot 84, which has such termination point at 96 at its left side. Although not shown, each slot is typically backed up by a metallic box or conductive cavity to allow radiation only in the forward or outward direction from each slot. It will be appreciated that an antenna in the form of an array of slots is particularly advantageous for implementation in a configuration flush with the surface of an aircraft. The present invention is readily adaptable to such applications.

The FIG. 11 antenna includes first excitation means shown as half-wave transmission lines 98 and 100 coupling the third and first elements 84 and 80 to the terminal means 16*a* via common voltage point 102. Reactive means 62*a* is shown coupled between point 102 and terminal 16*a* for providing double tuning in a desired frequency range. Second excitation means, shown as directional coupler 66*a*, is coupled between terminal 16*a* and second element 82, via transmission line section 70*a* and reactive means shown as LC circuit 68*a*. Operation of the FIG. 11 antenna is similar to the FIG. 6 antenna. Characteristics of slots permit use of transmission line sections 98 and 100 without provision for quarter wave transformers in providing a common voltage point enabling forcing of the voltages across the slots to have the desired magnitude and phase, substantially independently of mutual and other coupling and impedance effects. With slot radiators the significant signal component that determines the radiation pattern of an array is the slot voltage, in contrast to monopole or dipole radiators which have their currents as the significant signal components. Desired slot voltages for a good end-fire pattern with the FIG. 11 array have phase and amplitude values similar to the monopole currents shown in FIG. 5. The FIG. 11 system can provide this forced excitation together with double tuning for increased bandwidth.

Figure 12:
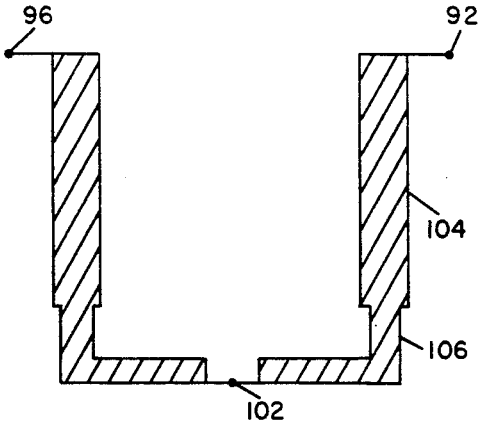
FIG. 12 and 13 are circuit diagrams of alternative forms of the FIG. 11 antenna.
Figure 13:
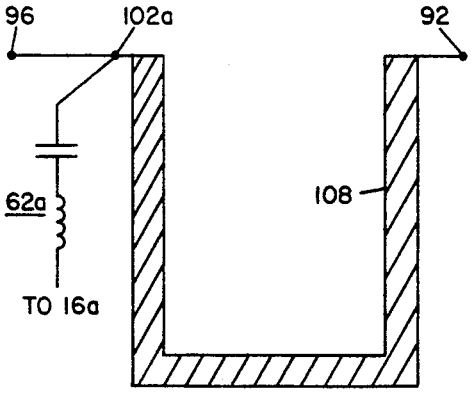

FIGS. 12 and 13 show alternative embodiments regarding the means connecting points 96 and 92 to point 102 in antennas which otherwise correspond to FIG. 11. In FIG. 12 the half wave transmission lines 98 and 100 have each been replaced be a series combination of two quarter wave transformers, such as transformers 104 and 106 shown as replacing line 100 between points 92 and 102. This arrangement provides wideband transformation of the slot conductance to a convenient value such as 50 ohms at point 102. In FIG. 13, half wave lines 98 and 100 have been replaced by a single full wavelength transmission line segment 108 connecting points 96 and 92, and reactive tuning circuit 62*a* connects to a point 102*a* in the vicinity of point 96. Variations such as shown in FIG. 13 can provide flexibility in particular applications.

The preceding embodiments are particularly shown and described in the context of an array of three radiating elements, however, it will be apparent that in some applications it may be desirable to provide one or more array antennas, each of which includes four or more radiating elements with forced excitation in accordance with the invention.

Figure 14:
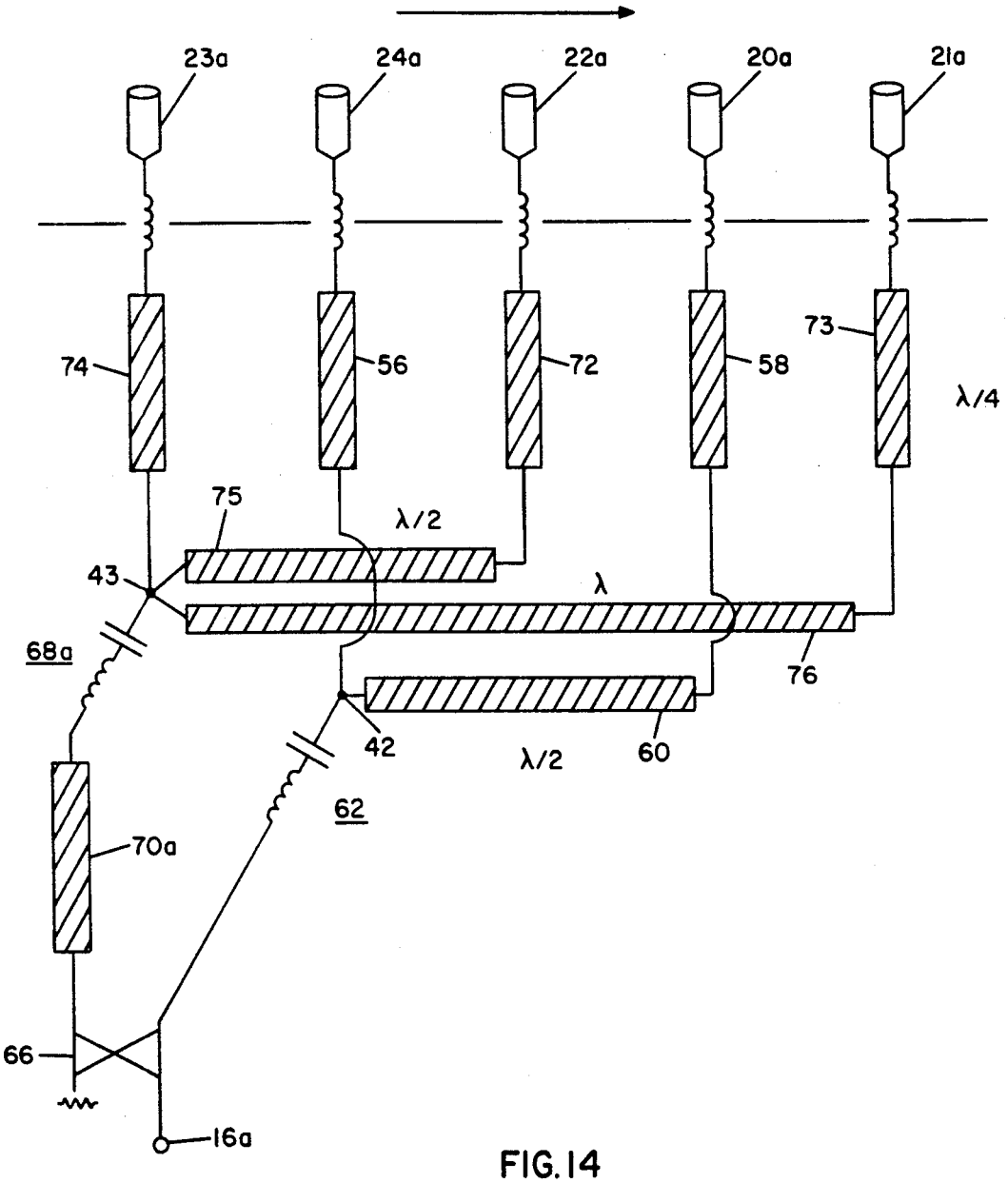
FIG. 14 is a circuit diagram of a five monopole array antenna in accordance with the invention.

Referring now to FIG. 14, there is illustrated an embodiment of the invention comprising a linear array of five antenna elements shown as monopoles 20*a* through 24*a*. As shown, the first, second and third elements 20*a*, 22*a* and 24*a* (corresponding to the first second and third elements of FIG. 6) have been supplemented by a leading element 21*a*, ahead of element 20*a*, and a trailing element 23*a*, following element 24*a*. In considering the FIG. 14 antenna, it is important to note that the arrangement and functioning of elements 20*a*, 22*a* and 24*a* are as described with reference to a three element array, the three element array of first, second and third elements being a basic subset used in antennas utilizing the invention.

In FIG. 14, elements 20*a*, 22*a* and 24*a* correspond to elements 20, 22 and 24 of FIG. 6. The FIG. 14 excitation system corresponds to the alternative excitation system of FIG. 9, with modification for excitation of the additional elements 21*a* and 23*a*. As shown in FIG. 14, a first group of non-adjacent antenna elements 20*a* and 24*a* are coupled to first excitation means shown as signal transmission means including halfwave transmission line 60 and quarterwave transformers 56 and 58. The remaining elements, middle element 22*a*, leading element 21*a* and trailing element 23*a*, are coupled to second excitation means shown as directional coupler 66, transmission line section 70*a*, quarterwave transformers 72, 73 and 74, and half and full wavelength transmission lines 75 and 76, respectively. Signals are coupled by the excitation means to elements 20*a* and 24*a* by way of common voltage point 42 and to elements 21*a*, 22*a* and 23*a* by way of a second common voltage point 43, permitting forced excitation.

If there were only four elements, the element 21*a*, transformer 73 and line 76 could be eliminated. For any number of elements there are actually two voltage points in accordance with the invention, to which signals are fed. For three elements, one of these voltage points is a common voltage point for two elements, permitting predetermined magnitudes and phases of current to be provided. For more than three elements the invention makes available two common voltage points, 42 and 43 for example, each connecting to two or more elements.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. An array antenna, comprising:

terminal means for coupling signals;

a plurality of antenna elements comprising at least first, second and third antenna elements for coupling radiated signals;

first excitation means, coupled between said terminal means and said first and third elements, comprising first and third signal transmission paths for coupling signal components of predetermined relative phase and amplitude to said first and third elements, respectively, by way of a point of common voltage included in said first excitation means, said first and third transmission paths including transmission line means having characteristics equivalent to a quarter wavelength transformer coupled between said point of common voltage and each of said first and third elements, said wavelength corresponding to approximately the average design frequency;

second excitation means, coupled between said terminal means and said second element, comprising a second signal transmission path for coupling to said second element a signal component of predetermined phase and amplitude relative to said signal components coupled to said first and third elements; and tuning means coupled to said point of common voltage for providing impedance matching for said first and third elements in a desired frequency range;

whereby signal components in said antenna elements are caused to have a predetermined relationship of phase and amplitude, substantially independently of intercoupling affecting antenna elements of the array antenna.

2. An array antenna as in claim 1, in which said antenna elements are monopoles.

3. An array antenna as in claim 1, in which said antenna elements are three monopoles.

4. An array antenna as in claim 3, in which said second signal transmission path comprises directional means for coupling a signal component of predetermined relative amplitude to said second antenna element, and second tuning means, coupled to said second signal transmission path, for providing tuning for said second element in said desired frequency range.

5. An array antenna as in claim 3 or 4, in which said first signal transmission path additionally comprises half wavelength transmission line means, coupled between said first element and said common voltage point, for coupling signals with a reversal in phase, said wavelength corresponding to approximately the average design frequency.

6. An array antenna as in claim 3 or 4, in which said second signal transmission path additionally comprises a quarter wavelength transformer coupled to said second element, said wavelength corresponding to approximately the average design frequency.

7. An array antenna as in claim 3 or 4, in which said first excitation means additionally comprises a quarter wavelength transformer coupled between said terminal means and said common voltage point, said wavelength corresponding to approximately the average design frequency.

8. An array antenna as in claim 2, 3 or 4, in which said antenna additionally comprises a protective cover and a base member enclosing said antenna elements, and said antenna, exclusive of said coupling means, has a height of less than one-eighth wavelength and a length of less than one wavelength, said wavelength corresponding to approximately the average design frequency.

9. An array antenna, comprising:

terminal means for coupling signals;

a plurality of antenna elements comprising a linear array of at least first, second and third antenna elements for coupling radiated signals;

first excitation means, coupled between said terminal means and a first group of non-adjacent elements including at least said first and third elements, comprising individual signal transmission paths for coupling a signal component of predetermined relative phase and amplitude to each element of said first group by way of a point of common voltage included in said first excitation means, said individual transmission paths including transmission line means having characteristics equivalent to a quarter wavelength transformer coupled between said point of common voltage and each element of said first group, said wavelength corresponding to approximately the average design frequency;

second excitation means, coupled between said terminal means and the remaining elements including at least said second element, comprising at least one additional signal transmission path for coupling a signal component of predetermined phase and amplitude to each of said remaining elements; and tuning means coupled to said point of common voltage for providing tuning for said first group of non-adjacent elements in a desired frequency range;

whereby signal components in said antenna elements are caused to have a predetermined relationship of phase and amplitude, substantially independently of intercoupling affecting antenna elements of the array antenna.

10. An array antenna, comprising:

terminal means for coupling signals;

five antenna elements comprising a linear array of first, second and third elements preceded by a leading element and followed by a trailing element;

first excitation means coupled between said terminal means and a first group of non-adjacent elements consisting of said first and third elements, comprising individual signal transmission paths for coupling a signal component of predetermined relative phase and amplitude to each element of said first group by way of a first point of common voltage included in said first excitation means, said individual transmission paths including transmission line means coupled between said first and third elements and having predetermined electrical characteristics effective for substantially preventing coupling of intercoupling effects occurring at said first and third elements;

second excitation means, coupled between said terminal means and said second, leading and trailing elements, comprising individual signal transmission paths for coupling a signal component of predetermined phase and amplitude to each of said second, leading and trailing elements by way of a second point of common voltage included in said second excitation means, said individual transmission paths each including transmission line means coupled between said second, leading and trailing elements and having predetermined electrical characteristics effective for substantially preventing coupling of intercoupling effects occurring at said second, leading and trailing elements;

first tuning means coupled to said first point of common voltage for providing tuning in a desired frequency range; and second tuning means coupled to said second point of common voltage for providing tuning in said desired frequency range; and whereby signal components coupled to said antenna elements are caused to have a predetermined relationship of phase and amplitude, substantially independently of intercoupling affecting antenna elements of the array antenna.

11. An array antenna as in claim 9 or 10, in which said antenna elements are monopoles.

12. An array antenna as in claim 1, 9, 10, 3 or 4, in which said antenna elements are spaced by approximately a quarter wavelength and each element is a monopole approximately one-tenth wavelength in height with arms projecting forward and rearward approximately one-tenth wavelength, said wavelength corresponding to approximately the average design frequency.

13. An array antenna as in claim 1, 9, 10, 3 or 4, in which said antenna additionally comprises a protective cover of radiation transmissive material and a base member having a reflective surface serving as a ground plane for said antenna elements.

14. An array antenna as in claim 9 or 10, in which said antenna elements are monopoles, said first excitation means comprises a plurality of quarter wavelength transformers coupled between said first common voltage point and individual elements in said first group, said second excitation means comprises directional coupler means and half wavelength transmission line means, said wavelength corresponding to approximately the average design frequency.

15. An array antenna as in claim 10, in which said antenna elements are slots in the form of elongated windows in a conductive surface.

16. An array antenna, comprising:

terminal means for coupling signals;

a plurality of antenna elements comprising at least first, second and third antenna elements, said antenna elements being slots in the form of elongated windows in a conductive surface, for coupling radiated signals;

first excitation means, coupled between said terminal means and said first and third elements, comprising first and third signal transmission paths for coupling signal components of predetermined relative phase and amplitude to said first and third elements, respectively, by way of a point of common voltage included in said first excitation means, said first and third transmission paths including transmission line means having characteristics equivalent to a quarter wavelength transformer coupled between said point of common voltage and each of said first and third elements, said wavelength corresponding to approximately the average design frequency;

second excitation means, coupled between said terminal means and said second element, comprising a second signal transmission path for coupling to said second element a signal component of predetermined phase and amplitude relative to said signal components coupled to said first and third elements; and tuning means coupled to said point of common voltage for providing impedance matching for said first and third elements in a desired frequency range;

whereby signal components in said antenna elements are caused to have a predetermined relationship of phase and amplitude, substantially independently of intercoupling affecting antenna elements of the array antenna.

17. An array antenna as in claim 16, in which said first and third signal transmission means comprise two half wavelength transmission lines coupled between said common voltage point and said first and third elements, respectively, said wavelength corresponding to approximately the average design frequency.

18. An array antenna as in claim 16, in which said first and third signal transmission means are replaced by a full wavelength transmission line coupled between said terminal means and said first element, and wavelength corresponding to approximately the average design frequency.

19. An array antenna as in claim 16, in which said first and third signal transmission means comprise two series combinations of two quarter wavelength transformers of different impedances, each such combination coupled between said common voltage point and one of said first and third antenna elements, respectively, said wavelength corresponding to approximately the average design frequency.

20. An array antenna as in claim 17, 18 or 19, in which said second excitation means comprises directional coupler means for coupling a signal component of predetermined relative amplitude to said second antenna element and second reactive means for providing tuning in a desired frequency range.

21. An array antenna as in claim 17, 18 or 19, in which three elongated slots are arranged side-by-side in a right to left orientation and said first excitation means is connected to said conductive surface adjacent to said first and third slots, said connections respectively being on the left side of the third slot and on the right side of the first slot.

22. An end-fire array antenna, comprising:

terminal means for coupling signals;

a plurality of antenna elements, comprising at least first, second and third monopole antenna elements;

first excitation means for coupling signals from said terminal means to said first and third elements for providing radiated signals of different phase at one element relative to the other, said first excitation means including transmission line means having characteristics equivalent to a quarter wavelength transformer coupled to said third element and transmission line means equivalent to the series combination of a quarter wavelength transformer and a half wavelength transmission line coupled to said first element, said wavelength corresponding to approximately the average design frequency;

second excitation means for coupling signals from said terminal means to said second element with a predetermined phase and amplitude different from said signals coupled to said first and third elements; and tuning means coupled to said first excitation means for providing double tuning in a desired frequency range;

whereby said excitation means are effective to cause signals in said antenna elements to have a predetermined relationship of phase and amplitude resulting in an antenna pattern having a principal beam in a forward direction.

23. An end-fire array antenna as in claim 22, in which said second excitation means comprises directional coupler means for coupling signals of predetermined relative amplitude to said second antenna element.

24. An end-fire array antenna as in claim 22, in which said second excitation means comprises quarter wavelength transformer means coupled to said second antenna element, said wavelength corresponding to approximately the average design wavelength.

25. An end-fire array antenna as in claim 22, in which said antenna elements are three monopoles, each less than one-eighth wavelength in height, said wavelength corresponding to approximately the average design frequency.

26. An end-fire array antenna as in claim 22, in which said antenna elements are three monopoles with quarter wave spacing and each monopole is approximately one-tenth wavelength in height with arms projecting forward and rearward approximately one-tenth wavelength, said wavelength corresponding to approximately the average design frequency.

27. An end-fire array antenna as in claim 22, additionally comprising a protective cover of radiation transmissive material and a base member having a reflective surface enclosing said antenna elements, and said antenna, exclusive of said coupling means, has a height of approximately one-eighth wavelength, said wavelength corresponding to approximately the average design frequency.

28. An end-fire slot array antenna, comprising:

terminal means for coupling signals;

a plurality of slot antenna elements, comprising at least first, second and third antenna elements;

first excitation means for coupling signals from said terminal means to said first and third elements for providing radiated signals of different phase at one element relative to the other, said first excitation means including transmission line means having predetermined electrical characteristics coupled to each of said first and third elements for isolating said first element from intercoupling effects affecting said third element and isolating said third element from intercoupling affects affecting said first element; and second excitation means for coupling signals from said terminal means to said second element with a predetermined phase and amplitude different from said signals coupled to said forward and rear elements;

whereby said excitation means are effective to cause signals in said antenna elements to have a predetermined relationship of phase and amplitude resulting in an antenna pattern having a principal beam in a forward direction.

29. An end-fire array antenna as in claim 28, in which said antenna additionally comprises tuning means coupled to said first excitation means for providing double tuning in a desired frequency range.

30. An end-fire slot array antenna as in claim 28 or 29, in which said antenna elements are three transverse elongated windows in a conductive surface, said first excitation means is coupled to a point near the forward edge of the first slot and to a similar point along the rear edge of the third slot, and said second excitation means is coupled to a similar point along one edge of the second slot.

31. An end-fire slot array antenna as in claim 28 or 29, in which said first excitation means comprises two half wavelength transmission lines respectively coupled to said first and third elements, said wavelength corresponding to approximately the average design frequency.

32. An end-fire slot array antenna as in claim 28 or 29, in which said first excitation means comprises a full wavelength transmission line coupled between said first and third elements, said wavelength corresponding to approximately the average design frequency.

33. An end-fire slot antenna as in claim 28 or 29, in which said first excitation means comprises two series combinations of quarter wavelength transformers respectively coupled to said first and third elements, said wavelength corresponding to approximately the average design frequency.

34. A low-profile array antenna suitable for aircraft installation, comprising:

a connector for coupling signals;

a first planar conductor pattern comprising first, second and third monopole antenna elements each less than one-eighth wavelength in height;

a second planar conductor pattern comprising first excitation means for coupling said connector to said first and third elements by way of quarter wavelength transformer means for coupling signal components, second excitation means for coupling said connector to said middle second element, and tuning means coupled to said first excitation means for providing double tuning in a desired frequency range; and a protective cover of radiation transmissive material;

wherein said wavelength corresponds to approximately the average design frequency, and whereby the antenna is suited for aircraft installation with reduced visual and air flow interference.

35. An array antenna as in claim 34, in which said first excitation means additionally comprises a half wavelength transmission line coupled between said connector and said first element to produce a phase reversal in signal components coupled to said first element relative to signal components coupled to said third element, to provide end-fire operation with a principal antenna beam in a forward direction.

36. An array antenna as in claim 34, in which said second excitation means comprises directional coupler means for coupling signals to said second element with a predetermined relative amplitude and second tuning means for providing double tuning in a desired frequency range.

37. An array antenna as in claim 34, 35 or 36, additionally comprising a base member for supporting said protective cover and said connector, and arranged to permit mounting of the antenna on an external surface of an aircraft with the connector arranged to protrude through a hole in the aircraft surface to permit coupling with an internal connector.

38. An antenna system comprising:

a plurality of array antennas, each comprising an array antenna as in claim 1, 9, 10, 22, 28 or 34, and means for supporting said antennas in a laterally spaced configuration.

39. An array antenna comprising:

a connector;

first, second and third monopole antenna elements;

three inductive tuners, one connected to each element;

a first excitation circuit comprising a quarter wavelength transformer connected between said third element tuner and a point of common voltage, a quarter wavelength transformer in series with a half wavelength transmission line connected between said first element tuner and said common voltage point and a reactive tuning circuit connected between said common voltage point and said connector;

a second excitation circuit comprising a directional coupler and transmission line section connected in series between said second element tuner and said connector, and a reactive tuning circuit coupled to said transmission line section;

a protective cover; and a base member for supporting said antenna elements.

* * * * *

UNITED STATES PATENT AND TRADEMARK OFFICE

CERTIFICATE OF CORRECTION

PATENT NO. : 5,206,656

DATED : April 27, 1993

INVENTOR(S) : Peter W. Hannan

It is certified that error appears in the above-identified patent and that said Letters Patent is hereby corrected as shown below:

ON THE TITLE PAGE:

Item Number 73 should be inserted as follows:

[73] Assignee: Hazeltine Corp., Greenlawn, N.Y.

Signed and Sealed this

Eleventh Day of January, 1994

Bruce Lehman

*Attest:*

BRUCE LEHMAN

*Attesting Officer*

*Commissioner of Patents and Trademarks*